United States Patent [19]

Fahlström et al.

[11] 4,345,990

[45] Aug. 24, 1982

[54] METHOD FOR RECOVERING OIL AND/OR GAS FROM CARBONACEOUS MATERIALS

[75] Inventors: Per A. H. H. Fahlström, Åkersberga; Karl G. Görling, Lidingö, both of Sweden

[73] Assignee: Boliden Åktiebolag, Stockholm, Sweden

[21] Appl. No.: 212,725

[22] PCT Filed: Apr. 11, 1980

[86] PCT No.: PCT/SE80/00105

§ 371 Date: Dec. 12, 1980

§ 102(e) Date: Nov. 5, 1980

[87] PCT Pub. No.: W080/02149

PCT Pub. Date: Oct. 16, 1980

[30] Foreign Application Priority Data

Apr. 12, 1979 [SE] Sweden ..... 7903283

[51] Int. Cl.[3] ..... C10G 1/02; C10B 49/14; C10B 53/06

[52] U.S. Cl. ..... 208/11 R; 48/197 R; 48/92; 201/10; 201/11; 208/8 R

[58] Field of Search ..... 48/197 R, 202, 206, 48/210, 92; 201/10, 11; 208/8 R, 11 R

[56] References Cited

U.S. PATENT DOCUMENTS

| | | | |
|---|---|---|---|
| 1,030,011 | 6/1912 | Pope | 201/10 |
| 2,787,584 | 4/1957 | Farafonow | 201/11 |
| 3,718,708 | 2/1973 | Ozawa et al. | 48/92 |
| 3,850,742 | 11/1974 | Dugan et al. | 48/202 |
| 3,966,583 | 6/1976 | Cramer . | |
| 4,070,160 | 1/1978 | Cottle | 48/197 R |

FOREIGN PATENT DOCUMENTS

| | | | |
|---|---|---|---|
| 2520584 | of 0000 | Fed. Rep. of Germany . | |
| 2521080 | of 0000 | Fed. Rep. of Germany . | |
| 2556732 | 6/1977 | Fed. Rep. of Germany | 48/197 R |
| 2236915 | of 0000 | France . | |
| 397364 | of 0000 | Switzerland . | |
| 1437750 | 6/1976 | United Kingdom . | |

*Primary Examiner*—Peter F. Kratz

*Attorney, Agent, or Firm*—Stevens, Davis, Miller & Mosher

[57] ABSTRACT

Disclosed is a method for recovering oil and gas from carbonaceous materials utilizing two molten baths. In the first molten bath reaction vessel, the carbonaceous material is thermally devolatilized. Part of the first melt from the first reaction vessel containing non-volatile constituents is passed to the second molten bath reaction vesel which contains a different melt at a higher temperature. The two melts are only partially soluble in each other so that they can be easily separated. Oxygen, air or oxides are charged to the second reaction vessel for gasifying residual quantities of carbon by oxidation. The first melt is returned to the first reaction vessel from the second reaction vessel. The melt in the first reaction vessel may comprise lead or zinc and be maintained at a temperature of 500° C., while the melt in the second reaction vessel may comprise raw iron and be maintained at a temperature of 1200° C.

12 Claims, 1 Drawing Figure

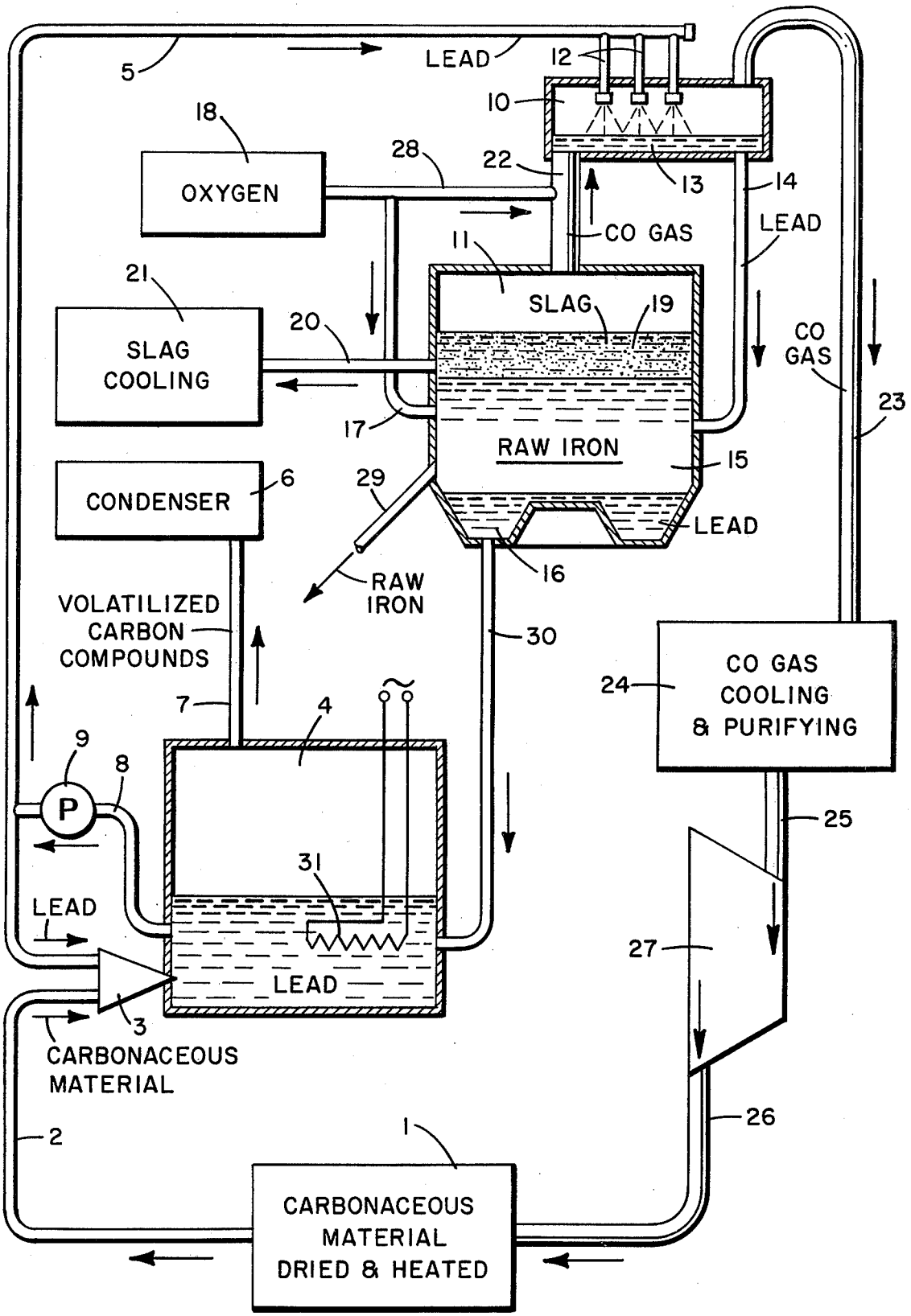
LEAD
5
12
10
18
OXYGEN
28
22
13
14
CO GAS
LEAD
11
21
SLAG
19
SLAG COOLING
20
CO GAS
23
17
RAW IRON
15
CONDENSER
6
29
LEAD
16
RAW IRON
VOLATILIZED CARBON COMPOUNDS
30
CO GAS COOLING & PURIFYING
24
7
4
9
8
P
25
31
LEAD
27
LEAD
3
CARBONACEOUS MATERIAL
26
2
1
CARBONACEOUS MATERIAL DRIED & HEATED

METHOD FOR RECOVERING OIL AND/OR GAS FROM CARBONACEOUS MATERIALS

The present invention relates to a method of continuously recovering oil and/or gas from carbonaceous material, by thermally treating said material in molten baths.

Developments in the fields of oil and nuclear energy have necessitated the search for new energy sources, interest being directed to carbonaceous minerals and other minerals containing carbon and hydro-carbons, for producing, for example, fuel having sufficient energy density to be used in combustion engines and for similar purposes. Such materials comprise coal, peat or shales, lignite and refinery residues, and biologically recovered material, such as seaweed, wood in all forms and the like. Several of the aforementioned materials contain volatile hydrocarbons, which can be condensed to liquid form and used as a valuable raw material in a number of chemical processes, such as for the production of methanol.

A large number of processes have been developed for recovering gaseous and liquid combustible substances from solid, carbonaceous fuels. The traditional gasworks is one such method, in which gas is recovered from lump coal by pyrolysis at temperatures over 800° C. Such thermal treatment for utilizing carbonaceous fuels, however, means that mainly methane, hydrogen gas and carbon monoxide and coke are obtained. Hydrocarbons higher than methane are decomposed.

Various methods have been developed for thermally treating materials at lower temperatures, for recovering volatile, combustible and condensable constituents. In this respect, the temperature should not exceed about 700° C., so as to avoid cracking of hydrocarbons which are volatile at normal temperatures. It is extremely difficult, however, to heat solid material in a manner such that volatile constituents can be driven off without the risk of overheating and partial cracking of the heated mass. Although a fluidized bed affords a practical manner of supplying heat to solid material, it is, inter alia, of great importance that the material is not excessively fine. Thus, fluidization of extremely fine material renders it difficult to achieve a sufficient residence time in the fluidized bed. Methods have also been proposed for pyrolysing, e.g., oil shale in aluminum melts, in which good heat transfer and pyrolysis of lump material have been achieved, although it has been impossible to avoid unacceptable admixture of aluminium with the pyrolysis residue.

Carbonaceous materials have also been gasified in molten slags, carbonate melts and raw-iron melts. Gasification implies a partial oxidation of the carbon content, by adding oxygen and/or water vapour.

The invention is disclosed in the accompanying claims. Thus, it has now been shown that a number of advantages can be gained if carbon-containing material is charged to an apparatus for thermal decomposition in two stages, in which stages the carbonaceous material is introduced into a first reactor vessel containing a melt, whose temperature is suitably beneath 700° C., in which melt volatile hydrocarbons are released, by pyrolysis, without appreciable risk of cracking hydrocarbons which are volatile at normal temperatures. Part of the melt is transferred, together with non-volatilized constituents remaining in the melt, to a second reactor vessel containing a melt having a higher temperature than the temperature of the melt in the first reactor, suitably over 800° C., preferably 1000°-1400° C., where the remaining amount of carbon in the material is gasified to carbon monoxide and hydrogen gas, by adding balanced quantities of oxygen in the form of oxygen gas, air, oxides or the like, whereafter melt and/or vapourized melt, i.e. material from said melt in vapourized form is returned to the melt of lower temperature contained in the first reactor vessel when the process is effected at atmospheric pressure. The hot melt and/or vapourized melt from the second reactor transfers to the melt of the first reactor, when returned thereto, substantially all the heat required to heat the material charged to said first reactor vessel and to volatilize the volatile hydrocarbons therein. The temperature in the second reactor is maintained primarily by combusting carbon transferred with the melt to carbon monoxide. Ash and residual products which are not combusted in the second reactor are suitably separated in the form of slags.

The melts in the two reactor vessels comprise different materials which can be mixed together only to a limited extent, so that the carbon-containing melt from the first reactor can be introduced into the melt in the second reactor without forming a common phase to any appreciable extent. The two melts comprise substances which are stable at the temperatures in question and which will not react chemically with each other at said temperatures. The melt in the first reactor may comprise a metal or metal alloy or certain inorganic compounds, such as sulphides, silicate, borates, fluoro-silicates or amorphous melts and alkali carbonates. In this respect, such metals as lead, zinc, tin, alloys thereof and the like, are preferred. With respect to the second reactor vessel, iron and manganese or alloys thereof are preferred, although, for example, molten carbonates or silicates can also be used. As an example of a suitable combination of melts can be mentioned lead or an alloy of lead with tin, in respect of the first reactor vessel, and a raw-iron alloy in the second reactor vessel. Lead and iron are practically insoluble in one another, even at hight temperatures, which means that lead can be separated from the raw-iron melt readily and quickly. Another pair of smelts is raw-iron or raw-iron alloys and zinc or zinc alloys. The raw-iron may e.g. be alloyed with mangan. In this case the separation of the smelts is suitably obtained by vapourization of zinc and by that the zinc is exhausted and returned to said first reactor vessel and therein condensed to molten form.

The first reactor vessel suitably may comprise a melting pot in which coal, shale in finely ground form, peat or biomass is introduced into a bath of molten lead, whereat volatile constituents are released without risk of cracking, and can be recovered for useful purposes from the gases from said stage after condensation, or in some other way. Heating in the molten lead bath enables practically the whole amount of volatile material at the temperature in question to be rapidly driven off without risk of local overheating, and therewith the accompanying risk of cracking. Molten lead containing residual, non-volatile carbon material is transferred from the first reactor vessel to the second reactor vessel, in which the lead melt is introduced into the raw-iron bath at a temperature of about 1200° C. Because of its greater density and immiscibility with iron, the lead settles to the bottom of the raw-iron bath, while at the same time intensively contacting the raw iron. Since carbon has both a lower density and is soluble in iron, the molten lead will release its carbon content to the raw-iron bath, the carbon content of the lead being progressively released during its passage through the bath. It should be ensured that the amount of molten iron and the residence time for carbon therein is sufficiently great to be able to dissolve the amount of carbon supplied, during passage of the lead through the raw-iron bath. Oxygen is also charged to the raw-iron bath in suitable quantities, for combusting the dissolved carbon and releasing the carbon in the form of carbon monoxide. When necessary, suitable quantities of slag-forming substances are also charged to the raw-iron bath, said substances cooperating to form a suitable slag, the choice of said slag former being dependent upon the composition of the input material and the nature of said material. Molten lead is returned from the bottom of the second reactor vessel to the first reactor vessel, in which the input heat is utilized to maintain the temperature of said first vessel.

To prevent the lead melt from being contaminated it is also possible to use the lead melt from the first reactor vessel in a lead production process which need addition of fuel and then recirculate pure lead melt from the production process to said first reactor vessel. It is also possible to use the lead production process as the second reactor vessel according to this invention.

Although the following description mainly refers to the preferred embodiment in which lead is used as the molten material in the first reactor vessel and iron is used as the molten material in the second reactor vessel, it will be obvious to one of normal skill in the art that a number of other combinations of melts can be used in the two reactors. Sulphur present in the material will be dissolved in an iron melt together with the carbon, owing to the fact that iron in liquid form has a high affinity to sulphur and carbon. Iron sulphides are formed, which migrate to a calcium-containing slag, which will float on the surface of the bath and which can be drawn off without sulphur entering the gas. Instead of iron, manganese can be used in the second reactor vessel, which can be of particular advantage, since the ability of manganese to bind sulphur is greater at said temperature than is the ability of iron. Thus, the sulphur is separated both from iron melts and manganese melts suitably in the form of a slag. The slag is formed by adding a suitably slag forming substance and flux to the metal bath. This slag can be regenerated by treating the same with water vapour, hydrogen sulphide being formed by the calcium sulphide present in the slag, and recovered. The slag can also be granulated under oxidizing conditions, whereat calcium sulphide can be converted to gypsum and used in this form as slag cement.

In a practical embodiment of the invention, the two reactor vessels are, of course, provided with suitable external devices and apparatus, such as heat exchangers, gas-cleaning apparatus, injection nozzles, liquid-metal conveying means, such as pumps, control means and the like. The novel method can be used, to advantage, for treating such materials as finely-ground coal, finely-ground shale, peat and finely-ground biological materials. The novel method is also potentially useful for treating oil residues and residues from the oil industry. The method can also be advantageously applied to the treatment of sulphur-containing products, whereat sulphur can be caused to form hydrogen sulphur and removed as such, or the sulphur can be bound in the slag. When treating materials containing heavy metals, the metals in question are enriched in the melts. Such heavy metals, can, in the majority of cases, be recovered by known metallurgical processes, either by treating the melt as a whole or by treating bleeds taken therefrom. Because mineral fuels and other fuels contain heavy metals to an increasing extent, and because of the environmental dangers associated with heavy metals, this possibility is of special importance. It is also known that finely-ground coal is difficult to heat, since it readily agglomerates, rendering it difficult to handle. Peat and similar materials are also difficult to handle in finely-ground form. The invention, however, will be more closely described with reference to the treatment of bituminous coal and parabituminous materials, although it lies within the knowledge of those skilled in the art to modify the method so as to enable other materials to be treated. If the carbonaceous material used is a shale, it should suitably be enriched, by removing therefrom, either mechanically or hydro-metallurgically, other minerals and gangue, prior to charging the fine-grain oil-bearing shale to the first reactor vessel, for releasing the volatile constituents of the shale.

The novel system according to the invention also affords particular-advantages, one such advantage being that very fine-grain mineral fuels can be treated without the particles agglomerating. Highly enriched mineral-fuel concentrates can also be effectively treated. Very rapid reactions are obtained within narrow temperature ranges, which affords a high degree of freedom when selecting the mineral fuel. It is possible to produce a maximum amount of oil and heavy hydrocarbons while, at the same time, fully utilizing the calorific value of non-volatile, carbonaceous minerals. Further, the heat-economy of the process is good. Problems associated with such impurities as sulphur, heavy metals and arsenic can be solved, and the emission of such impurities avoided. From the aspect of apparatus, molten-bath reactor vessels are relatively simple and have a higher capacity in relation to volume than, for example, reactors in which the reaction is carried out in gas phase in a fluidized bed. The technique applied here does not require extensive material and process development, since the individual stages, such as metal pumps and reactors, are known, or known apparatus can be used without requiring extensive development work.

The process can suitably be carried out at atmospheric pressure in both reactors, although it is also possible to use pressures above atmospheric and vacuum conditions. Thus, vacuum conditions can be applied in the first reactor vessel, whereby the same volatilization result can be obtained with pyrolysis at a lower temperature. This also reduces the risk of cracking and the need to transfer heat from the second reactor vessel to the first reactor vessel. The mentioned vacuum condition can be established by connecting a vacuum tank to the lead melt.

If it is desired to hydrate carbon residues, to obtain a larger quantity of hydrocarbons, the first reactor vessel, or the whole system, can be arranged to work under a pressure of at least 1 MPa, hydrogen gas being introduced into the first reactor vessel, or optionally into an intermediate reactor vessel, subsequent to removing the heavy hydrocarbons. Gasification can also be effected at a pressure above 1 MPa.

The second vessel comprises a system of a plurality of vessels in which different oxygen potentials are maintained, and, for example, in which water is added to some part of the system.

The invention will now be illustrated with reference to the accompanying drawing, the single FIGURE of which is a principle diagram of a two-stage method for pyrolysis, gasification and the manufacture of carbon monoxide from carbonaceous materials. The illustrated plant comprises a storage 1 for carbonaceous material, in which said material is dried and pre-heated to about 100° C. Extending from the storage 1 is a line 2, arranged to convey carbonaceous material to an injection location 3, where carbonaceous material is mixed with re-circulated lead having a temperature of about 500° C., said injection location 3 having one or more injection nozzles arranged thereat. The mixture of carbonaceous material and lead is injected into a first reactor vessel 4, in which volatile carbon compounds are volatilized. The volatilized compounds can be passed, through a line 7, to a condensing device 6, for condensing oil and purifying gas for use in a desired manner. Lead and non-volatile constituents in the material can be pumped continously from the reactor 4, through a line 8, by means of a pump 9, partly to the injection location 3 and partly to a gas cooler 10 via a line 5. Gas generated in a second reactor vessel 11 is also passed to the gas cooler 10. Lead is injected by injection means 12 into the gas cooler, to disperse therein, and is allowed to fall down through the gas to a store 13, from which lead, with non-volatile parts of the material, is introduced into the reactor 11 through a line 14. The reactor vessel 11 contains a raw-iron bath 15 having a temperature of about 1200° C., the lead melt being introduced into the bath 15 at a location far beneath the surface of the bath. Carbon in the material is dissolved in the raw-iron, while lead, which is soluble in iron to only a limited extent, settles to the bottom of the bath gravitationally and forms a bottom layer 16. Molten lead is transferred, via a line 30, from the reactor vessel 11 to the reactor vessel 4, by means of one or more spray nozzles. Sufficient heat can be supplied to the vessel 4 in this way. The reactor 4 and also the reactor 11 may also be provided with electrical heating elements 31. Oxygen gas is supplied to the bath 15 of raw-iron from an oxygen gas store 18 through a line 17, for partial combustion of carbon in the raw-iron, suitably using tuyeres, to form carbon monoxide gas. If so required, slagging substances can be supplied to the raw-iron bath 15, for taking up impurities and ash in the slag resulting in a slag layer 19, which can be tapped off through a line 20 to a cooling stage 21, where the slag is cooled to a suitable temperature and allowed to form, for example, slag cement while recovering heat in the form of superheated steam. The carbon monoxide gas formed is passed, through a line 22, to the gas cooler 10, and from there through a line 23, to a gas-purifying and gas-cooling means 24, where the gas is purified, whereafter said gas is removed, through a line 25, for use, for example, under combustion in a gas turbine 27. For the purpose of drying and pre-heating carbonaceous material, there is used the output gas from the turbine, as shown with line 26. Oxygen gas for partial combustion of the carbon-monoxide gas can be passed to the line 22 through a line 28. The material often contains iron, which will be gradually taken up in the raw-iron phase, and hence the process also allows raw-iron to be tapped off, as indicated at 29.

EXAMPLE 1

In a plant of the kind illustrated in the FIGURE, 100 tons of enriched, fine-grain mineral fuel were charged each hour into the first reactor vessel, which was made of cast iron and which contained 50 tons of lead having a temperature of 500° C. The mineral—fuel was charged to said reactor vessel with the aid of re-circulated lead, through a plurality of ejector nozzles. The amount of lead charged to the furnace was 190 tons/-hour. 39 tons of oil per hour and 6 tons of gas/h were driven off in the reactor vessel, corresponding to a heating effect of 523 MW. 665 tons/h of lead were pumped each hour to the gas cooler, by means of a pump having a power consumption of 50 kW, before charging the molten lead to the second reactor vessel, in which cooler the temperature of the lead melt increased to 800° C. The second reactor vessel had a ceramic lining and contained 250 tons of molten raw-iron having a height of 2.8 m and a temperature of 1200°. The molten lead was charged to the raw-iron bath at a location 2 meters beneath the surface of the bath. Carbon contained by the lead melt was taken up in the raw-iron melt, the molten lead falling gravitationally to the bottom of the second reactor vessel to form a lead layer containing 80 tons of lead. About 610 tons of lead having a temperature of 1200° C. were returned each hour to the first reactor vessel, thereby supplying said first vessel with the requisite amount of heat.

The carbon dissolved in the raw-iron bath was combusted to carbon monoxide, by introducing into the second vessel 12000 $Nm^3/h$ oxygen at a location 0,2 m beneath the surface of the raw-iron bath, using tuyeres 0.25 200 $Nm^3/h$ of gas were formed. For the purpose of combusting part of the combustible components of the gas, 1000 Nm/h of oxygen gas were supplied thereto, whereby sufficient heat was generated to raise the temperature of the molten lead with pyrolysis residues present therein to a temperature of 800° C. in the cooler. 31 MW were generated in the gas turbine. The turbine heat was used to dry and pre-heat input carbonaceous material to a temperature of about 100° C. Calcium was charged to the second reactor vessel for the purpose of taking-up sulphur and forming gypsum, and 400 kg/h of slag were removed from the reactor, said slag having a basicity of 0.2 and a sulphur content bound as calcium sulphide of 6%. The slag in the form obtained is well suited for the manufacture of slag-cement. By granulating the slag it was possible to gain 1.2 MW. The energy required to produce the necessary amount of oxygen gas was 1.3 MW.

EXAMPLE 2

In a plant with a first reactor vessel containing a zinc melt, 100 tons of enriched, fine-grain material mineral fuel were charged each hour with the aid of re-circulated zinc melt in an amount of 120 tons each hour through a plurality of ejector nozzles. The reactor vessel contained 30 tons zinc melt at a temperature of 500° C. 38 tons oil per hour and 6.5 tons gas per hour, corresponding to a heating effect of 517 MW were driven off. 417 tons of zinc melt per hour were pumped to a second reactor vessel containing a raw-iron melt with a manganese content of 17 percent by weight. To this second reactor vessel air and slagging substances were supplied.

The non-pyrolised carbon content of the mineral fuel following the zinc melt was dissolved in the raw-iron melt and gasified therefrom forming a process gas containing coal substantially in the form of carbon monoxide. This process gas was driven off together with zinc in vapour form. The zinc vapour and the process gas were re-circulated to the first reactor vessel, where the zinc vapour was condensed and made it possible to maintain the temperature at about 500° C. The process gas was lead to a waste heat boiler where the remaining combustion heat of the gas was recovered.

We claim:

1. A method of recovering volatile constituents from carbonaceous materials by pyrolysis and gasification, whereby the material is introduced into a first reactor vessel containing a first melt in which volatile constituents are driven off by thermal treatment, and subsequently recovered, and wherein part of the first melt containing the non-volatile constituents of said carbonaceous material is transferred to a second reactor vessel containing a second melt at a temperature greater than the temperature in the first reactor, the first and the second melts being mutually different melts whose solubility in one another is limited and which can be physically separated, and whereby said first and said second melts are brought together to transfer to and to absorb into said second melt said non-volatile constituents, and wherein one of the members of the group consisting of oxygen, air, and oxides is also introduced into the second melt for gasifying residual quantities of carbonaceous material present in said non-volatile constituents by oxidation; and metal melt from the second reactor vessel is returned to the first reactor vessel in a quantity to substantially maintain the temperature therein and to replace the quantity of the first melt transferred from said first reactor vessel to the second reactor vessel.

2. The method according to claim 1, wherein the temperature in the first reactor is held beneath 700° C. while the temperature in the second reactor is above 800° C.

3. The method according to claim 1, wherein the first melt in the first reactor comprises molten lead or lead-tin-alloy having a temperature of about 500° C. and the second melt in the second reactor vessel comprises molten raw iron having a temperature of about 1200° C.

4. The method according to claim 1, wherein the first melt in the first reactor vessel comprise molten zinc or zinc-alloy having a temperature of 450°-600° C. and the second melt in the second reactor vessel comprise molten raw-iron alloy having a temperature of about 1200° C.

5. The method according to claim 4, wherein zinc is returned in vapour form to the first reactor vessel together with gasified coal products.

6. The method according to claim 1, wherein the carbonaceous material is a parabituminous material.

7. The method according to claim 1, wherein ash and non-combustible residual products are slagged in and removed from the second reactor vessel.

8. The method according to claim 1, wherein heat is transferred from the gas passing from the second reactor after further combustion, to the first melt from the first reactor vessel, prior to said melt being charged to the second reactor vessel.

9. The method according to claim 8, wherein the first melt from the first reactor is pumped to the gas cooler and from there is passed gravitationally to the second reactor vessel, and then back to the first reactor vessel.

10. The method according to anyone of claims 1, 2, 3, 4, 5, 6, 7, or 8, wherein said carbonaceous material is introduced into the first reactor vessel with the aid of recirculated first melt, through one or more injector nozzles; and in that said first melt is introduced into said second melt in the second reactor vessel beneath the surface of the bath.

11. A method according to claim 2, wherein the temperature in the first reactor is between 400° and 600° C., and in the second reactor is between 1000° and 1400° C.

12. A method according to claim 6, wherein the parabituminous material is enriched oil shale.

* * * * *